US007392683B2

(12) United States Patent
Lüthi et al.

(10) Patent No.: US 7,392,683 B2
(45) Date of Patent: Jul. 1, 2008

(54) METHOD FOR PRODUCING A ROLLED EDGE

(75) Inventors: Rudolf Lüthi, Niederwangen (CH); Yasar Renkci, Bern (CH); Hans Jöhr, Kehrsatz (CH)

(73) Assignee: Adval Tech Holding AG, Niederwangen (CH)

( * ) Notice: Subject to any disclaimer, the term of this patent is extended or adjusted under 35 U.S.C. 154(b) by 98 days.

(21) Appl. No.: 10/473,690

(22) PCT Filed: Mar. 18, 2002

(86) PCT No.: PCT/CH02/00158

§ 371 (c)(1),
(2), (4) Date: Mar. 12, 2004

(87) PCT Pub. No.: WO02/081118

PCT Pub. Date: Oct. 17, 2002

(65) Prior Publication Data

US 2004/0139779 A1 Jul. 22, 2004

(30) Foreign Application Priority Data

Apr. 6, 2001 (CH) ..... 655/01

(51) Int. Cl.
*B21D 22/00* (2006.01)
*B21D 19/00* (2006.01)
*B21D 11/10* (2006.01)

(52) U.S. Cl. ..... 72/356; 72/348; 72/370.11; 72/379.4

(58) Field of Classification Search ..... 72/356–359, 72/352, 350, 379.4, 715, 347–348, 352.2, 72/370.1, 370.11, 343, 306, 316
See application file for complete search history.

(56) References Cited

U.S. PATENT DOCUMENTS

| | | | | | |
|---|---|---|---|---|---|
| 2,114,596 | A | * | 4/1938 | Franghia | 72/348 |
| 3,037,473 | A | * | 6/1962 | Whistler, Sr. et al. | 72/328 |
| 3,726,244 | A | | 4/1973 | Arangelovich et al. | |
| 4,113,133 | A | | 9/1978 | Berthet | |
| 4,207,761 | A | * | 6/1980 | Niemi | 72/354.2 |
| 4,637,961 | A | * | 1/1987 | Bachmann et al. | 428/579 |
| 4,667,499 | A | * | 5/1987 | Bull | 72/352 |
| 4,711,611 | A | * | 12/1987 | Bachmann et al. | 413/69 |
| 4,862,722 | A | * | 9/1989 | Fraze et al. | 73/336 |

FOREIGN PATENT DOCUMENTS

| | | |
|---|---|---|
| DE | 1452744 | 6/1969 |
| EP | 0297754 A | 1/1989 |
| WO | WO02081118 A1 | 10/2002 |

* cited by examiner

*Primary Examiner*—Derris H. Banks
*Assistant Examiner*—Teresa M Bonk
(74) *Attorney, Agent, or Firm*—Sughrue Mion, PLLC

(57) ABSTRACT

The invention relates to a method for the production of a rolled edge from an edge section (11) of a tube, wherein a flanging die is driven onto the edge section and flanges it into a roll. According to the invention, an initial area (14) of the edge section (11) is previously rolled in a positive fit manner by means of a forcibly controlled tool (30). This prevents buckling of the initial area (14), which has a controlled geometry as a result of rolling. The novel method is preferably used in the production of valve seats in so-called aerosol domes (10) for spray cans.

8 Claims, 4 Drawing Sheets

METHOD FOR PRODUCING A ROLLED EDGE

TECHNICAL FIELD

The present invention relates to a method for producing a rolled edge from an edge section of a tube, in which a flanging die moves into the edge section and flanges the latter to form a roll.

Methods of this type are used, inter alia, during the production of "aerosol domes" for spray bottles, a tubular section of this dome being formed into just such a rolled edge for accommodating a valve disk. High demands are made especially here on the precision and thin sheets of only a few tenths of a millimeter thickness have to be processed.

PRIOR ART

During the production of the rolled edge on the aerosol domes nowadays, a flanging die having a certain radius moves into a tube section, produced beforehand on the aerosol dome by drawing, and flanges the edge of this tube section to form a roll. The shape and size of the rolled edge are largely determined here by the geometry of the flanging die and of its radius referred to. During this forming operation, however, the initial zone of the rolled edge regularly does not have the desired radius but rather more of a rectilinear form. A type of kink forms between the more straight initial zone and the adjoining radially deformed zone. This effect is caused by the inherent stability of the sheet and, as a result, becomes all the more pronounced the thinner and harder the sheet is. In addition, there are irregularites in the material and in the tool which have a similar effect and cause uneven, uncontrolled deformations overall.

The relationships described above are to be described in more detail with reference to FIGS. 1, 2*a*)-2*e*) and 3.

FIG. 1 shows, in a longitudinal section, an aerosol dome 10 having a tube section 11 and a flanging die 21, having a radius 22, of a forming tool 20 (not shown in any more detail). The initial state with the still unformed tube section 11 and the flanging die 21 in its starting position is shown on the left-hand side of FIG. 1. The right-hand part of FIG. 1 shows the flanging die 21 in its end position. When the die 21 moves between the starting and end positions, the tube section 11 (or, depending on the length of the tube section, at least an edge section of the same), deforms along the radius 22 to form a roll 12.

FIGS. 2*a*)-2*e*), in each case in a detail enlargement A of FIG. 1, show details of the rolling operation. It can be seen that the kink 13 referred to is produced during the transition from FIG. 2*a*) to FIG. 2*b*), with a virtually rectilinear initial zone 14 being formed, this kink 13 being unfavorably retained during the further forming process according to FIGS. 2*c*)-2*e*). From the forming technology point of view, the initial zone 14 constitutes an uncontrolled geometry zone. It leads to a variable height H (cf. FIG. 2*e*) of the rolled edge 12 and thus also to an uncontrolled, irregular edge geometry 15, as shown in FIG. 3 in a partial view of the formed aerosol dome.

SUMMARY OF THE INVENTION

The invention, as characterized in the patent claims, proposes that, in a method of the type mentioned at the beginning, an initial zone of the edge section first of all be rolled in a preliminary form-fitting manner by a positively controlled tool before the actual production of the rolled edge with the flanging die.

In this way, the sheet, in the critical initial zone, is already given a prior controlled geometry having the desired radius. Kink formation is avoided. In the following forming stage, it is thereby possible to produce a rolled edge which is more regular and more constant in its geometry.

The result of the controlled preliminary rolling is also that tensile stresses, caused by the expansion of the sheet during the rolling, are distributed more evenly over the periphery of the sheet edge and thus the risk of radial crack formation in the sheet is reduced. This increases the safety of the process, which again is important and advantageous in particular during the production of aerosol domes.

Harder and thinner sheets can be processed with the proposed method, thereby resulting in savings in the consumption of raw material. This is also of decisive importance during aerosol dome production, since the material costs constitute an important factor in view of the large quantities.

An exemplary embodiment of the invention, again with reference to aerosol dome production, is to be explained with reference to the drawing. However, it goes without saying that the invention can also be applied to any other desired tube sections which are to be rolled.

WAYS OF IMPLEMENTING THE INVENTION

Figure 4:
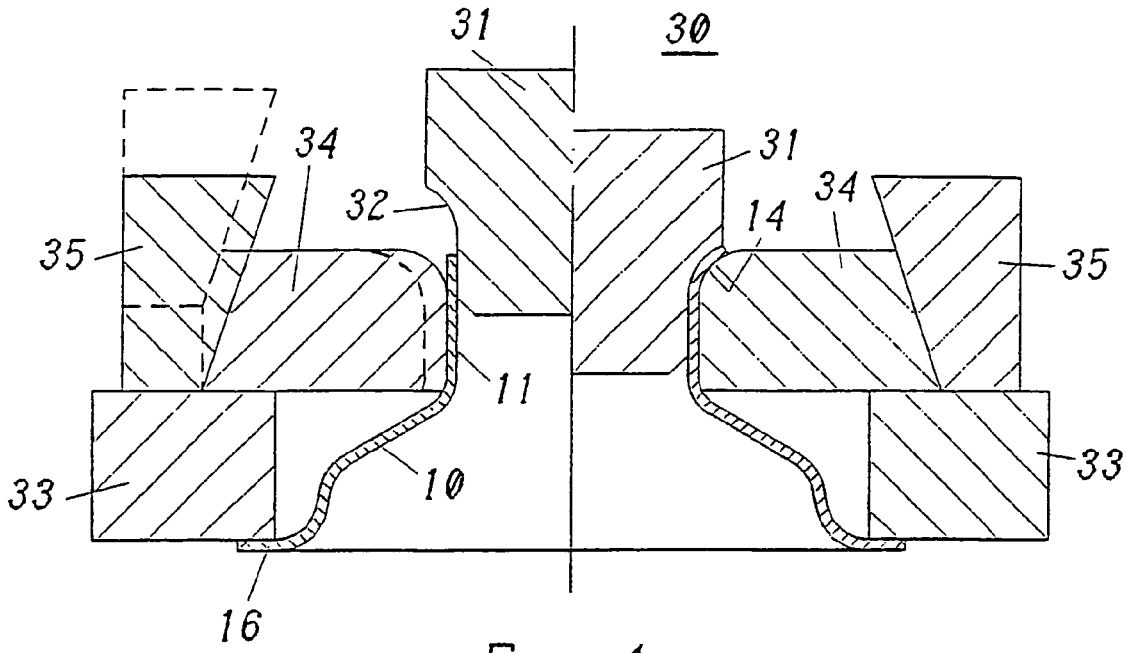
FIG. 4 shows, in a longitudinal section, an aerosol can with a tube section in a preliminary rolling tool in two positions, to be precise still unformed on the left and completely rolled in a preliminary manner on the right.
Figure 5:
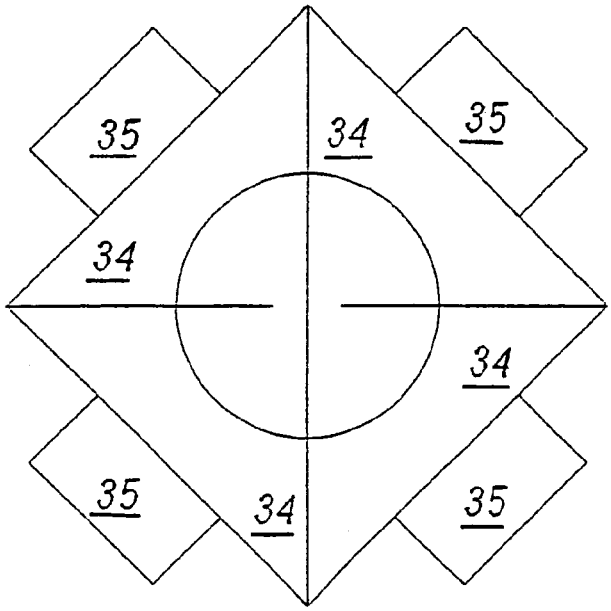
FIG. 5 shows a plan view of the preliminary rolling tool.

In FIG. 4, an aerosol dome having a tube section 11 is again designated by 10 but is in this case placed in a preliminary rolling tool 30. The latter comprises a preliminary rolling die 31, having a radius 32, at least one hold-down 33, a plurality of pressure pads 34 and a corresponding number of slides 35. According to FIG. 5, the pressure pads 34 may be designed as four radially movable segments which together limit or clear a circular opening. The initial state with the still unformed tube section 11 and the preliminary rolling die 31 in its starting position is shown on the left-hand side of FIG. 4. However, the parts 33-35 are already located in their end or functional position. They reach the latter from a release position, shown by broken lines, by first of all the hold-down 33 moving downward together with the pressure pads 34 until it strikes an annular edge 16 of the aerosol dome. The slides 35 are then moved downward onto the hold-down 33. By virtue of the fact that they are coupled to the pressure pads 34 via an inclined surface, they push the pressure pads 34 radially inward in the process right into their end position shown for the embossing operation. The right-hand part of FIG. 4 shows the preliminary rolling die 31 in its end position. When the preliminary rolling die 31 moves between its starting and end positions, an initial section 14 of the tube section 11 is rolled in a preliminary manner and provided with the radius 32. After that, the preliminary rolling die 31 is withdrawn again from the tube section, the slides 35 are moved upward, the pressure pads 34 are moved radially outward, the hold-down 33 is moved upward, and the aerosol dome 10 is thereby released.

Figure 1:
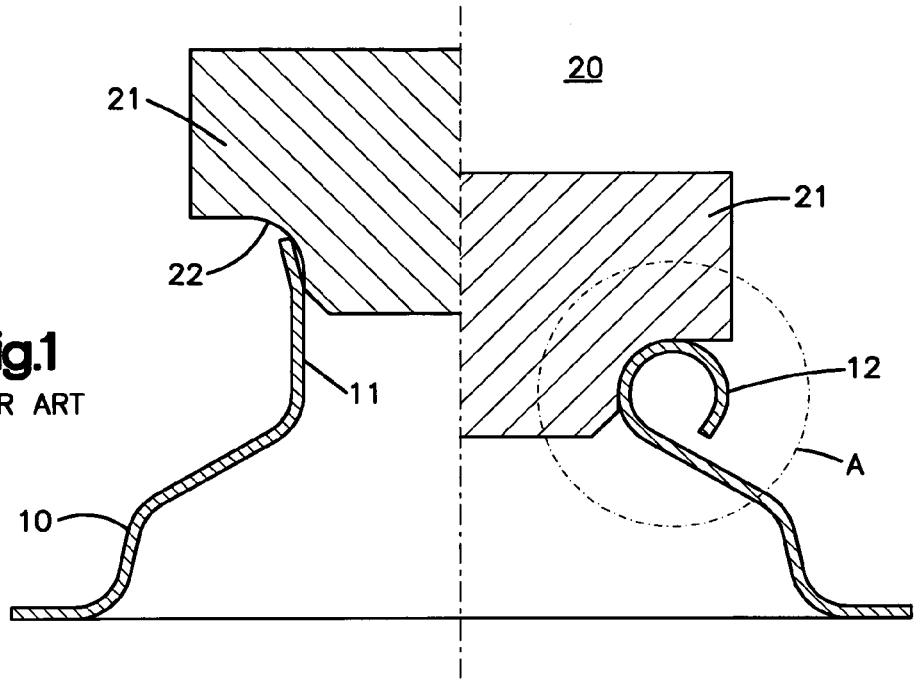
Fig.1 PRIOR ART
FIGS. 1-3 show the figures already explained for illustrating the relationships in the prior art.
Figure 1A:
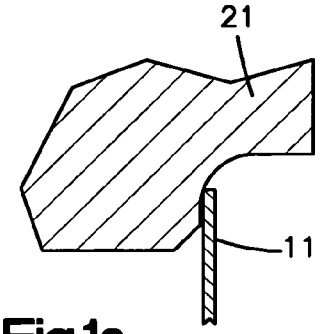
Fig.1a PRIOR ART
Figure 1B:
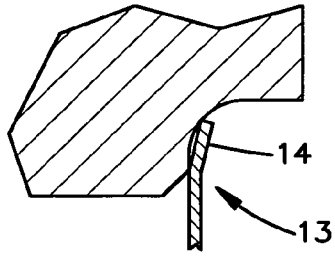
Fig.1b PRIOR ART
Figure 2A:
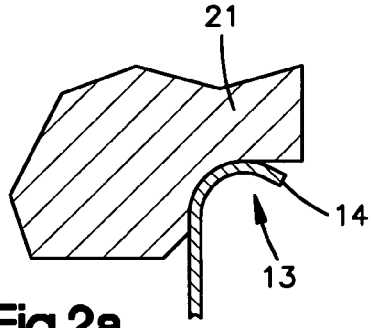
Fig.2a PRIOR ART
Figure 2B:
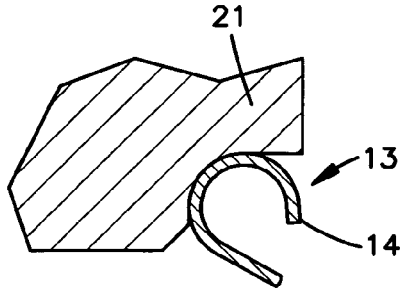
Fig.2b PRIOR ART
Figure 2C:
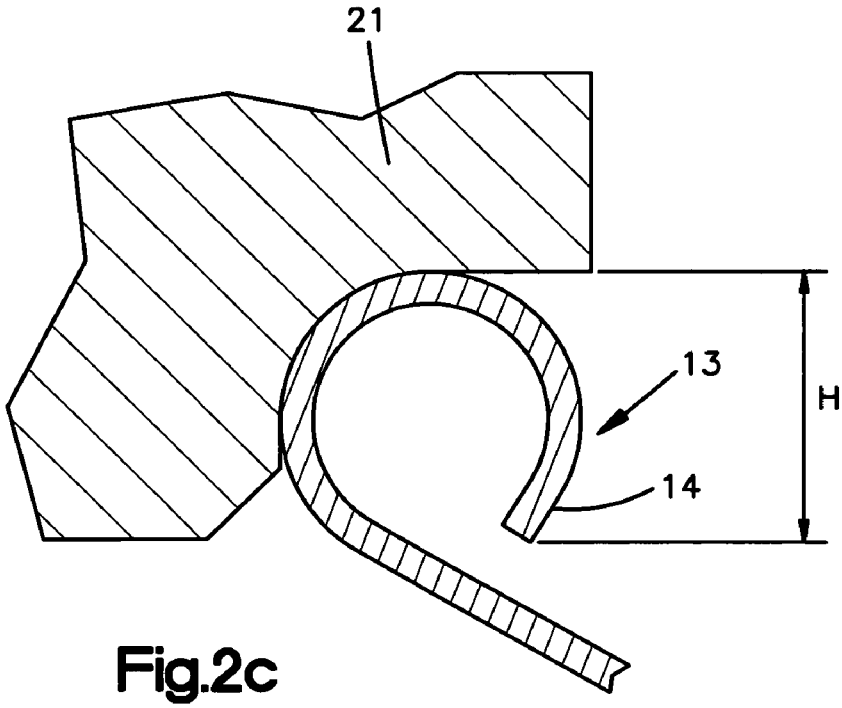
Fig.2c PRIOR ART
Figure 3:
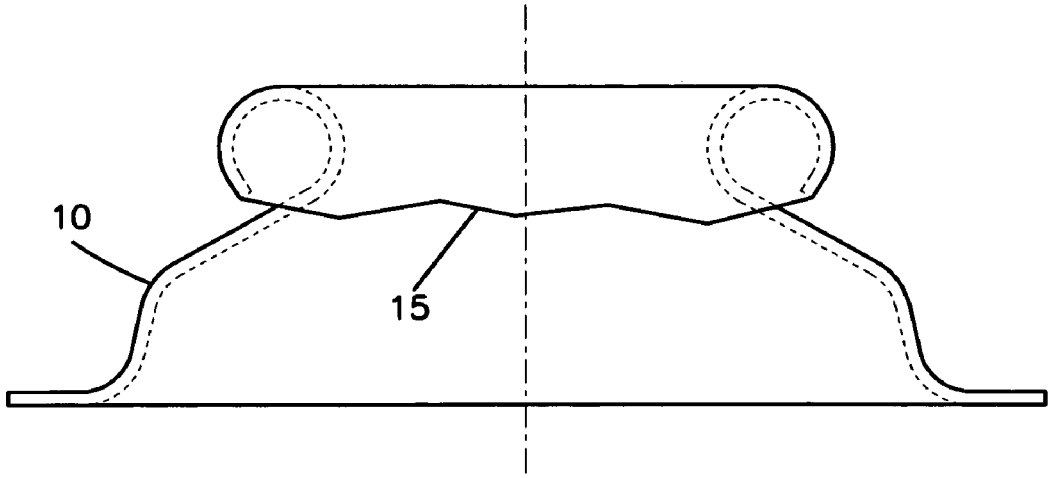
Fig.3 PRIOR ART
Figure 6:
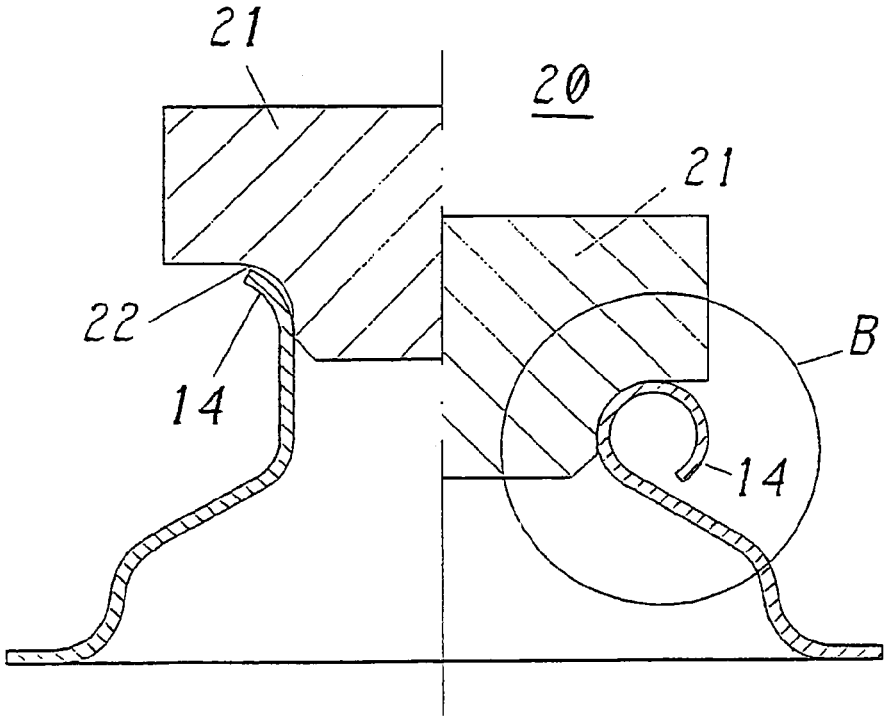
FIG. 6 shows a representation corresponding to FIG. 1 of an aerosol dome and of a flanging die in two positions, although one the aerosol dome has an initial zone already rolled in a preliminary manner.
Figure 7:
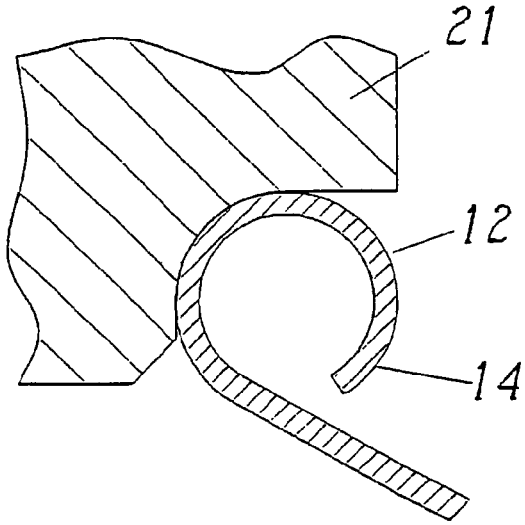
FIG. 7 shows, in a detail enlargement B of FIG. 6, a completely rolled edge according to the invention in detail.

In the preliminary rolled state as described above, the aerosol dome 10 or its tube section 11 can then continue to be formed in a similar manner to the method already explained with reference to FIGS. 1 and 2, FIG. 6 showing a representation corresponding to FIG. 1. Here, however, it can be seen that the initial zone 14, rolled in a preliminary manner, of the tube section 11 already conforms in a form-fitting manner to the radius 22 of the flanging die 21 in the starting position shown on the left-hand side. For this purpose, the radius 22 of the flanging die 21, on the one hand, and the radius 32 of the preliminary rolling die 31 are also preferably dimensioned the same. During the further rolling with the flanging die 21, the initial zone 14 retains its controlled radius, as shown in the detail B of FIG. 6 in FIG. 7, which shows the completely rolled edge section.

LIST OF DESIGNATIONS

10 Aerosol dome
11 Tube or edge section of the aerosol dome
12 Roll
13 Kink
14 Initial zone
15 Edge geometry
16 Annular edge
20 Forming tool
21 Flanging die
22 Radius at the flanging die
30 Preliminary rolling tool
31 Preliminary rolling die
32 Radius at the preliminary rolling die
33 Hold-down
34 Pressure pad
35 Slide

The invention claimed is:

1. A method for producing a rolled edge from an edge section of a tube, in which a flanging die moves into the edge section and flanges the edge section to form a roll, comprising:

performing a preliminary rolling at an initial zone at the terminal edge of the edge section in a preliminary form-fitting manner by a positively controlled tool in order to produce a start roll, the positively controlled tool comprising a preliminary rolling die and corresponding pressure pads, the preliminary rolling die having a radius, the pressure pads having the same radius, the flanging die having the same radius and the form-fittingly rolled initial zone having the same radius.

2. The method as claimed in claim 1 wherein the positively controlled tool comprises a plurality of outer pressure pads, radially adjustable with respect to an axis of the tube, preliminary rolling of the initial zone at the terminal edge of the edge section being carried out in the following steps:

adjusting the outer pressure pads radially inward until the outer pressure pads strike the edge section;

moving the preliminary rolling die into the edge section such that the initial zone at the terminal edge is rolled in a preliminary and form fitting manner between the radius of the preliminary rolling die and the corresponding radius for the pressure pads generating the same radius in said initial zone at the terminal edge, moving the preliminary rolling die out of the tube section; and moving the outer pressure pads radially outward thereby axially clearing the edge section.

3. The method as claimed in claim 1 , wherein a roll is made on a tubular section of an aerosol dome for spray cans accommodating a valve disk.

4. The method as claimed in claim 2, wherein a roll is made on a tubular section of an aerosol dome for spray cans accommodating a valve disk.

5. A method for producing a rolled edge from an edge section of a tube, in which a flanging die moves into the edge section and flanges the edge section to form a roll, comprising:

performing a preliminary rolling at an initial zone at the terminal edge of the edge section in a preliminary form-fitting manner by a positively controlled tool in order to produce a start roll, the positively controlled tool comprising a preliminary rolling die and corresponding pressure pads, the preliminary rolling die having a radius, the pressure pads having the same radius, the flanging die having the same radius and the form-fittingly rolled initial zone having the same radius, and wherein said initial zone is form-fittingly pressed between the radius of the preliminary rolling die and the corresponding radius of the pressure pads generating the same radius in said initial zone.

6. The method as claimed in claim 5, wherein the positively controlled tool comprises a plurality of outer pressure pads radially adjustable wit respect to an axis of the tube, preliminary rolling of the initial zone at the terminal edge of the edge section being carried out in the following steps:

adjusting the outer pressure pads radially inward until the outer pressure pads strike the edge section, moving the preliminary rolling die into the edge section such that the initial zone at the terminal edge is rolled in a preliminary and form fitting manner between the radius of the preliminary rolling die and the corresponding radius for the pressure pads generating the same radius in said initial zone at the terminal edge, moving the preliminary rolling die out of the tube section; and moving the outer pressure pads radially outward thereby axially clearing the edge section.

7. The method as claimed in claim 5 , wherein a roll is made on a tubular section of an aerosol dome for spray cans accommodating a valve disk.

8. The method as claimed in claim 6, wherein a roll is made on a tubular section of an aerosol dome for spray cans accommodating a valve disk.

* * * * *